US009357900B2

(12) United States Patent
Marone et al.

(10) Patent No.: US 9,357,900 B2
(45) Date of Patent: Jun. 7, 2016

(54) COMBINED ASSEMBLY FOR DISPENSING WASHING AGENTS AND OZONE FOR A WASHING MACHINE, IN PARTICULAR A DISHWASHING MACHINE

(71) Applicant: ELBI INTERNATIONAL S.p.A., Turin (IT)

(72) Inventors: Giuseppe Marone, Nichelino (IT); Sergio Damilano, Trinita' (IT)

(73) Assignee: ELBI INTERNATIONAL S.P.A., Turin (IT)

( * ) Notice: Subject to any disclaimer, the term of this patent is extended or adjusted under 35 U.S.C. 154(b) by 0 days.

(21) Appl. No.: 14/395,860

(22) PCT Filed: Apr. 30, 2013

(86) PCT No.: PCT/IB2013/053407

§ 371 (c)(1),
(2) Date: Oct. 21, 2014

(87) PCT Pub. No.: WO2013/164762

PCT Pub. Date: Nov. 7, 2013

(65) Prior Publication Data

US 2015/0075563 A1 Mar. 19, 2015

(30) Foreign Application Priority Data

Apr. 30, 2012 (IT) ..... TO2012A0379

(51) Int. Cl.
*A47L 15/42* (2006.01)
*A47L 15/44* (2006.01)

(52) U.S. Cl.
CPC ..... *A47L 15/4418* (2013.01); *A47L 15/424* (2013.01); *A47L 15/4409* (2013.01); *A47L 15/4257* (2013.01)

(58) Field of Classification Search
CPC ..... A47L 15/4418
See application file for complete search history.

(56) References Cited

U.S. PATENT DOCUMENTS 6,057,770 A * 5/2000 Justesen ..... G01M 3/18 340/514
6,085,556 A * 7/2000 Moon ..... D06F 35/001 68/13 A
2012/0291816 A1 11/2012 Heiligenmann et al.

FOREIGN PATENT DOCUMENTS

| | | | |
|---|---|---|---|
| EP | 1 989 988 | A1 | 11/2008 |
| IT | TO2011 000101 | A1 | 8/2012 |
| WO | 2005/063109 | A1 | 7/2005 |
| WO | 2009/021973 | A1 | 2/2009 |
| WO | 2012/107886 | A8 | 8/2012 |

OTHER PUBLICATIONS

International Search Report for PCT/IB2013/053407 dated Oct. 23, 2013.

* cited by examiner

*Primary Examiner* — Michael Barr
*Assistant Examiner* — Jason Riggleman
(74) *Attorney, Agent, or Firm* — Sughrue Mion, PLLC

(57) ABSTRACT

An assembly including an integrated device for dispensing washing agents, having a body intended to be mounted in an opening of a sheet-like wall which delimits the washing chamber and which has a peripheral formation which protrudes towards the outside and is intended to abut against the surface of the wall surrounding the opening, on the side of the wall which faces the washing machine; and an ozone-generating device, with a housing which has an outlet opening and contains electric ozone-flow generating means suitable for emitting a flow of ozone towards the outlet opening, so as to introduce it into the washing chamber of the machines.

3 Claims, 6 Drawing Sheets

COMBINED ASSEMBLY FOR DISPENSING WASHING AGENTS AND OZONE FOR A WASHING MACHINE, IN PARTICULAR A DISHWASHING MACHINE

CROSS REFERENCE TO RELATED APPLICATIONS

This application is a National Stage of International Application No. PCT/IB2013/053407 filed Apr. 30, 2013, claiming priority based on Italian Patent Application No. TO2012A00379 filed Apr. 30, 2012, the contents of all of which are incorporated herein by reference in their entirety.

The present invention relates to an assembly for dispensing washing agents and ozone into the washing chamber of a washing machine, in particular a dishwashing machine.

More specifically the invention relates to an assembly comprising

- an integrated device for dispensing washing agents, comprising a body intended to be mounted in an opening of a sheet-like wall which delimits the washing chamber and which has a peripheral formation which protrudes towards the outside and is intended to abut against the surface of said wall surrounding said opening, on the side of said wall which faces the washing machine; and
- an ozone-generating device, with a housing which has an outlet opening and contains electric ozone-flow generating means suitable for emitting a flow of ozone towards said outlet opening, so as to introduce it into the washing chamber of the machine.

According to the prior art, an integrated washing-agent dispensing device, for example of the type described in Italian patent application TO2011A000101 is typically associated with the washing chamber of a dishwashing machine, being normally mounted in an opening provided in the wall of the door for accessing said chamber.

In some cases, an ozone-generating device is also associated with the washing chamber of a dishwashing machine, said device being intended to introduce a flow of (air and) ozone into said chamber, during at least one step of a washing cycle. This ozone-generating device is separate and distinct from the washing-agent dispensing device and is mounted in, or at least connected to, an opening provided in a wall of the washing chamber, in a location different from that of the washing-agent dispensing device.

This solution is not convenient from the point of view of ease and convenience of installation of the aforementioned devices.

One object of the present invention is to provide an assembly for dispensing washing agents and ozone which is able to overcome the above-described drawback of the solutions according to the prior art.

This object, together with other objects, is achieved according to the invention by an assembly of the type specified above, characterized in that

- in the body of the washing-agent dispensing device there is defined an outlet chamber able to communicate, in the condition of use, with the washing chamber and having an inlet chamber accessible from the outside, and in that

- the housing of the ozone-generating device can be coupled to the body of the washing-agent dispensing device so as to be supported by said body, with respect to which it can assume a working position in which the outlet opening thereof is sealingly coupled with the inlet passage of said outlet chamber so as to allow the supply of a flow of ozone from said ozone-generating means towards the latter; in said working position the housing of the ozone-generating device extending with an orientation such that in the condition of use it may extend behind said sheet-like wall of the washing chamber.

In one embodiment the housing of the ozone-generating device can be coupled to the body of the washing-agent dispensing device in a rotatable manner and is able to assume with respect thereto

- an angular mounting position, in which it can be introduced, together with said body, through the opening in the aforementioned wall of the washing chamber, and
- a subsequent, stable, working position, after the assembly has been mounted in said opening of the wall of the washing chamber.

According to a further characteristic feature, an electric cut-off valve device, preferably of the normally closed kind, suitable for controlling the supply of ozone from said outlet chamber to the washing chamber of the machine is associated with the aforementioned outlet chamber of the body of the washing-agent dispensing device.

Further characteristic features and advantages of the invention will become clear from the following detailed description provided purely by way of a non-limiting example, with reference to the accompanying drawings in which.

Figure 1:
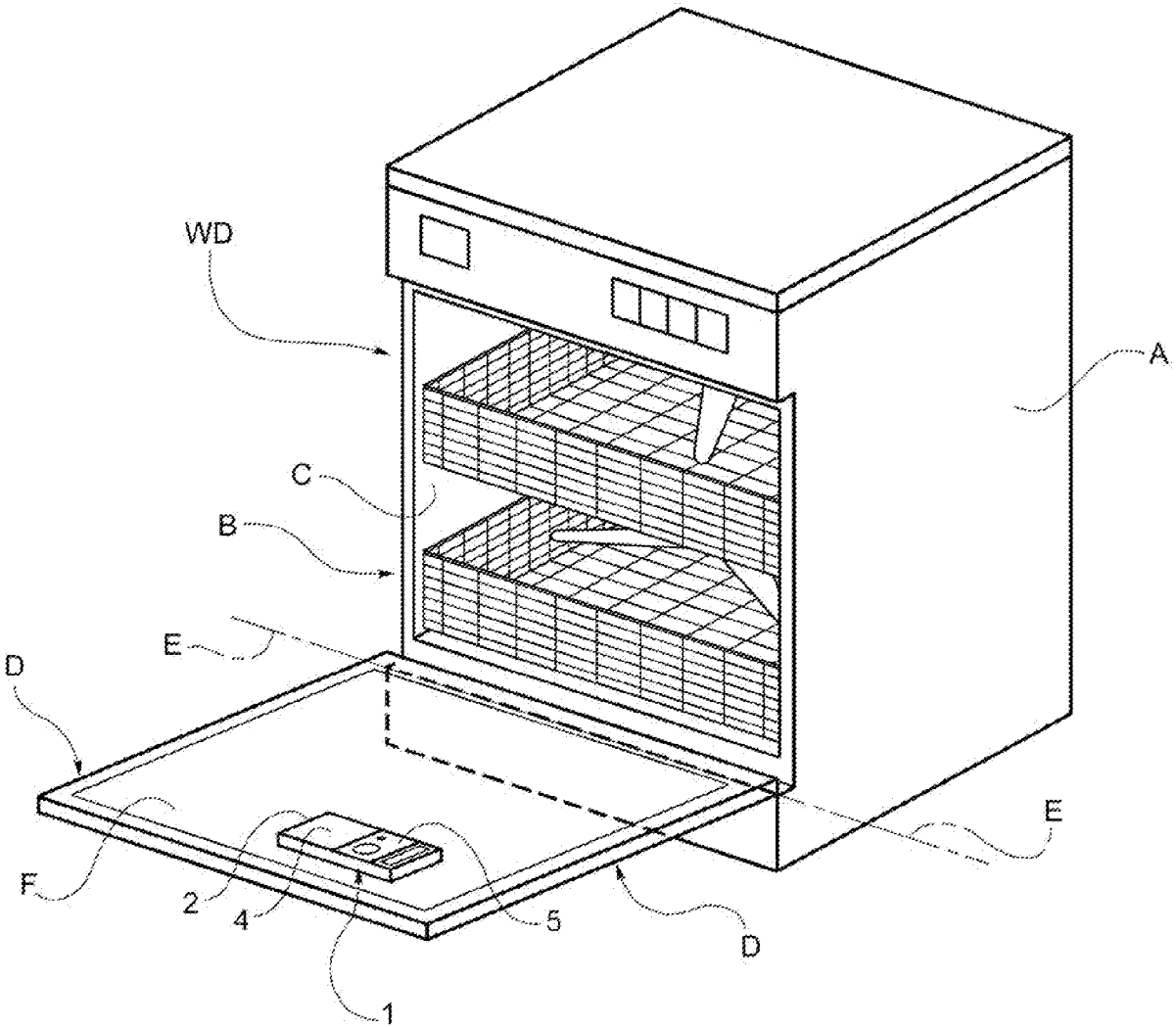
FIG. 1 is a perspective view of a dishwashing machine provided with a combined assembly for dispensing washing agents and ozone according to the present invention.

In FIG. 1, WD denotes overall a dishwashing machine. This machine comprises a housing A, with an essentially parallelepiped form, provided with a front opening B through which the washing chamber C of the machine may be accessed.

The front opening B has, associated therewith, a closing door D which can be pivoted relative to the housing A of the machine WD about an essentially horizontal axis indicated by E-E in FIG. 1.

Figure 2:
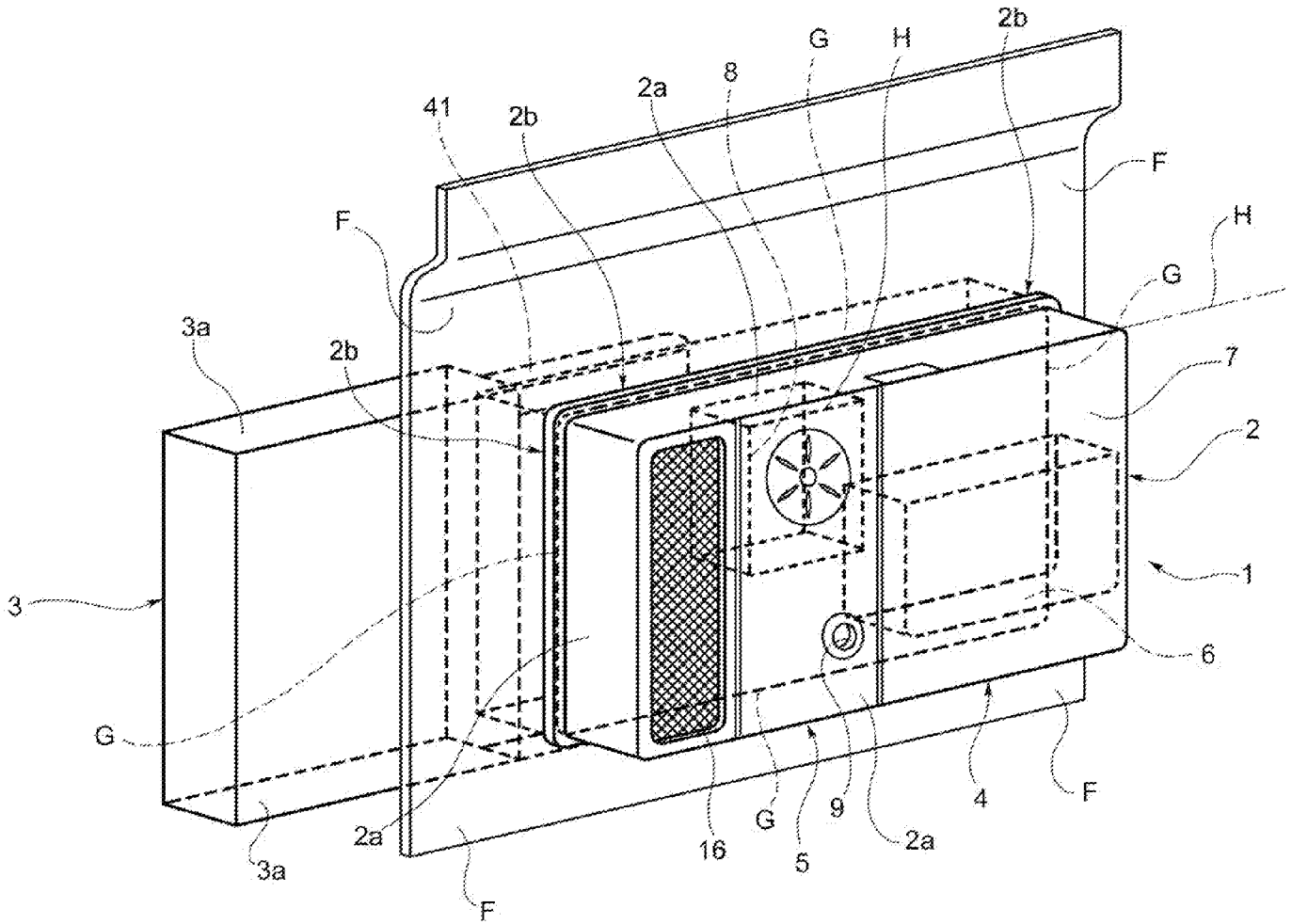
FIG. 2 is an essentially front perspective view of a combined assembly according to the present invention.

On the side facing the washing chamber C, the door D has a sheet-like wall F, typically made of sheet metal. An opening G, shown in broken lines in FIG. 2, is formed in this wall F. In the example of embodiment shown the opening G is essentially rectangular.

A combined assembly for dispensing washing agents and ozone, denoted overall by 1 in the drawings, is mounted in the opening G of the wall F of the door D.

With reference in particular to FIGS. 2 to 5, the combined assembly 1 comprises an integrated washing-agent dispensing device denoted overall by 2 and an ozone-generating device denoted overall by 3.

The integrated washing-agent dispensing device is for example of the type described and shown in the preceding Italian patent application mentioned in the introductory part of the present description.

In the embodiment shown the integrated dispensing device 2 comprises a body 2*a* made of moulded plastic which has, formed therein, in a manner known per se a first releasing device 4, for dispensing a detergent, in particular in powder form, and an adjacent second releasing device 5 for dispensing a liquid rinsing agent (see in particular FIG. 2).

The releasing device 4 for the detergent comprises a receptacle 6 (FIG. 2) which is essentially tray-shaped and has an associated cover 7. This cover is for example mounted rotatably about an axis indicated by H-H in FIG. 2. This cover 7 could moreover be coupled to the body 2*a* in a translatable or rotary-translatable manner.

The releasing device 5 for the rinsing agent is likewise of the type known per se. It comprises a receptacle 8 (FIG. 2) suitable for receiving a quantity of rinsing agent corresponding to a plurality of doses. The dosed dispensing of the rinsing agent into the washing chamber C of the dishwashing machine WD is, in a manner known per se, controlled by means of a normally closed cut-off valve, arranged along a duct able to connect the receptacle 8 to this washing chamber and emerging inside an outlet opening 9 (FIG. 2) on the front of the integrated dispensing device 2.

Figure 3:
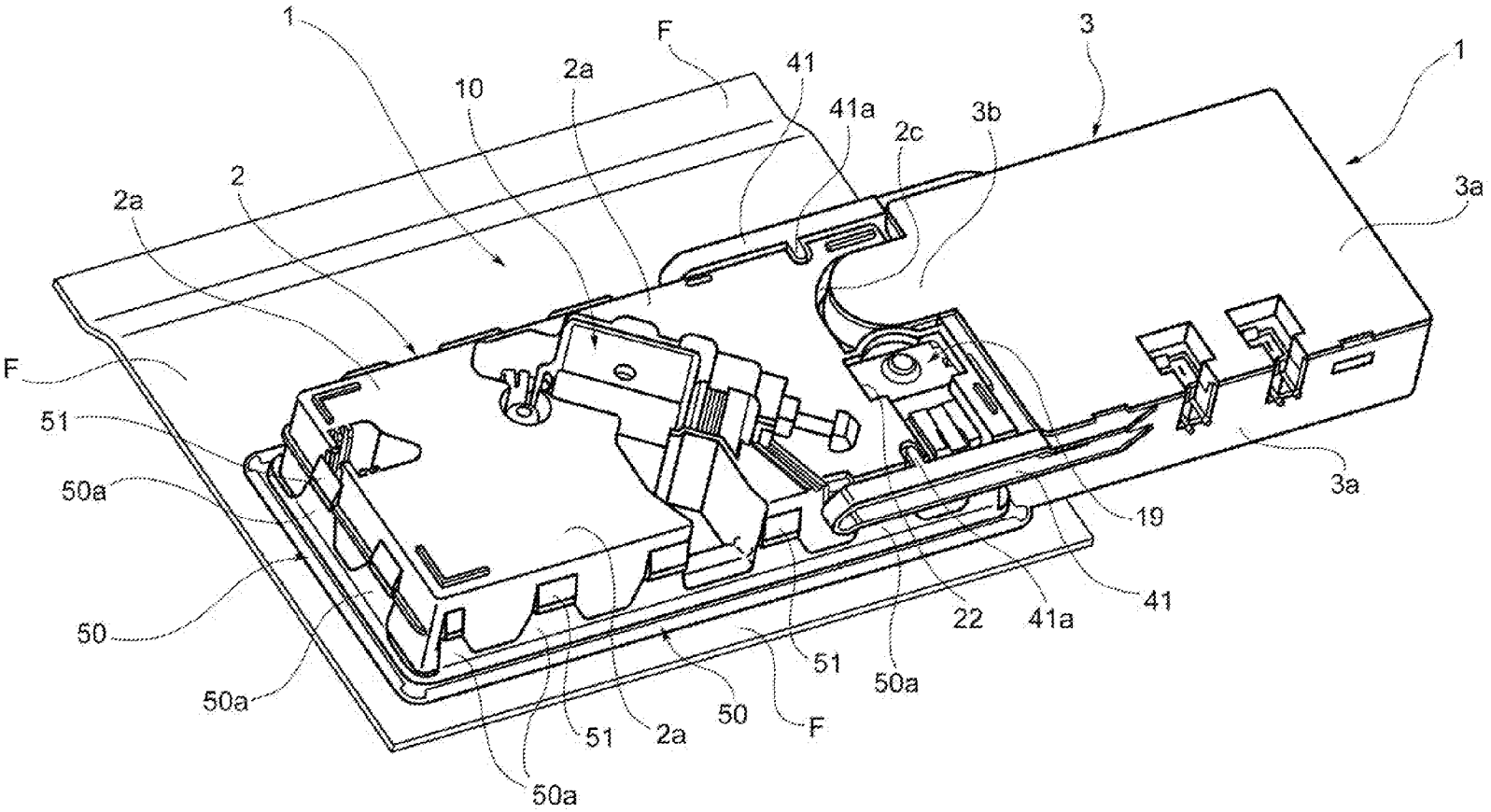
FIGS. 3 and 4 are two—essentially rear—perspective views of a combined assembly according to the invention.

Dispensing of the detergent and the rinsing agent may be controlled by means of a single electrically controlled actuator device, denoted overall by 10 in FIGS. 2 and 3, substantially in accordance with the solution described and illustrated in the previously mentioned Italian patent application. This solution is particularly convenient, but its use is not obligatory: alternatively solutions of the type comprising two separate actuators may also be adopted.

Figure 5:
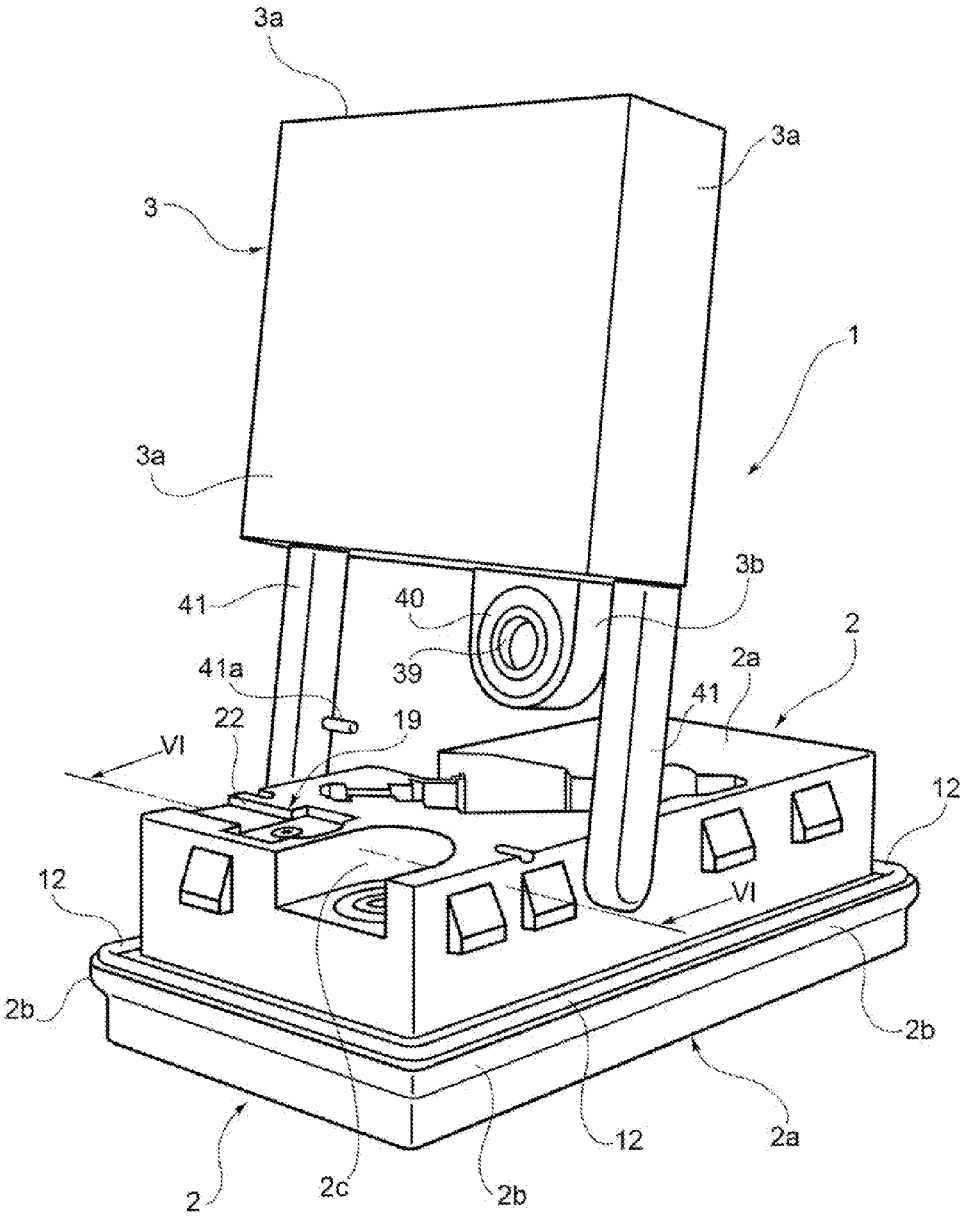
FIG. 5 is a perspective view of a combined assembly according to the invention shown in a condition where the ozone-generating device is arranged in an angular mounting position.
Figure 6:
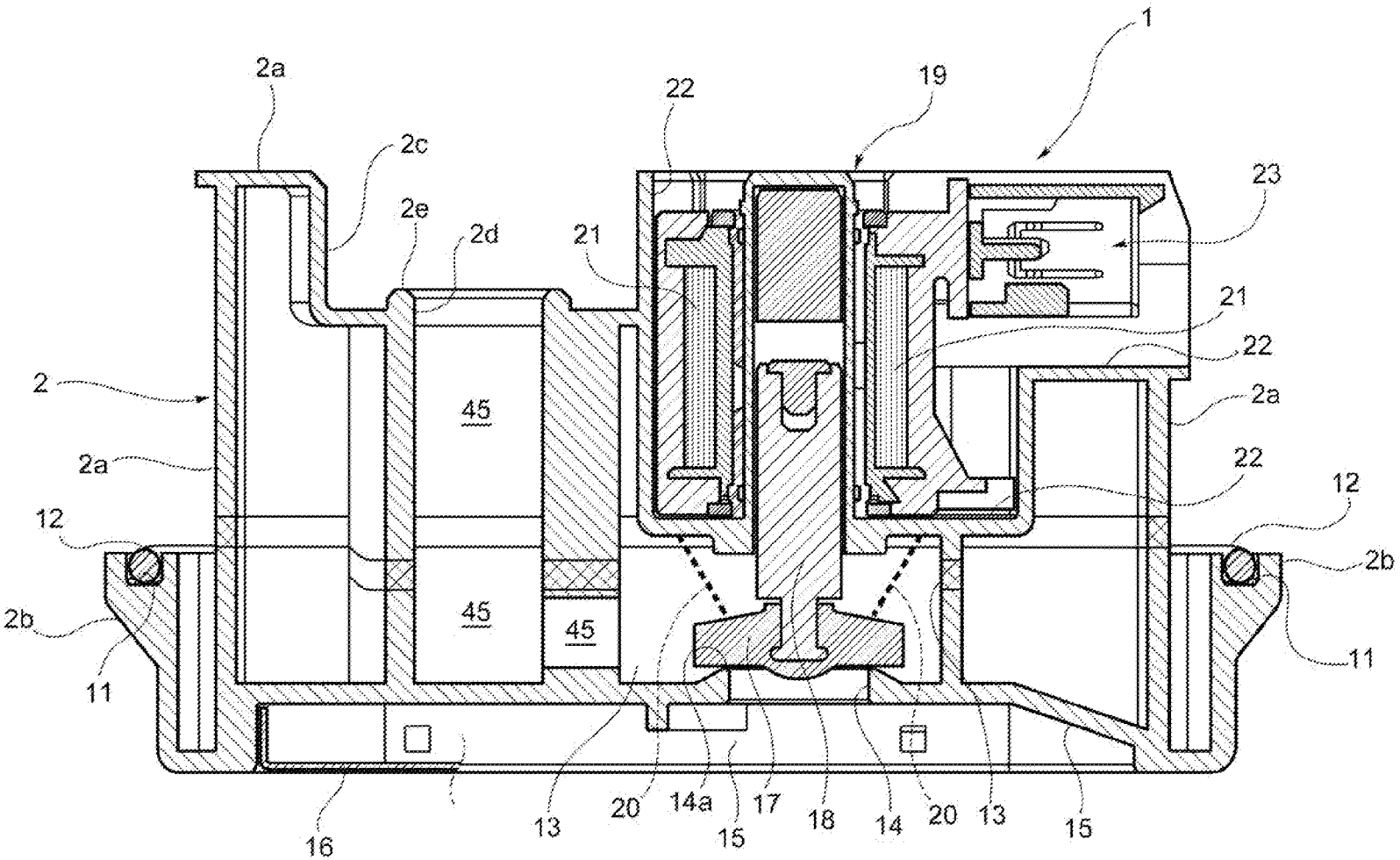
FIG. 6 is an essentially perspective view along the line VI-VI of FIG. 5.

The body 2*a* of the integrated dispensing device 2 has a peripheral formation 2*b* protruding towards the outside (see in particular FIGS. 2, 5 and 6). On the side facing the sheet-like wall F, this protruding formation 2*b* has a groove—denoted by 11 in FIG. 6—inside which a seal 12 is arranged (see also FIG. 5).

An outlet chamber 13 denoted by 13 in FIG. 6 is defined in the body 2*a* of the washing-agent dispensing device 2. This chamber has an opening 14 directed towards the washing chamber C. In the embodiment shown the opening 14 faces a front recess 15 of the body 2*a* of the integrated dispensing device 2 which is fitted with a covering grille 16, visible in FIG. 2 and partly in FIG. 6.

As can be seen in FIG. 2, in the embodiment shown the opening 14, the recess 15 and the associated grille 16 are located on the opposite side to the detergent dispensing device 4 relative to the rinsing agent dispensing device 5. This arrangement is however not obligatory.

Figure 4:
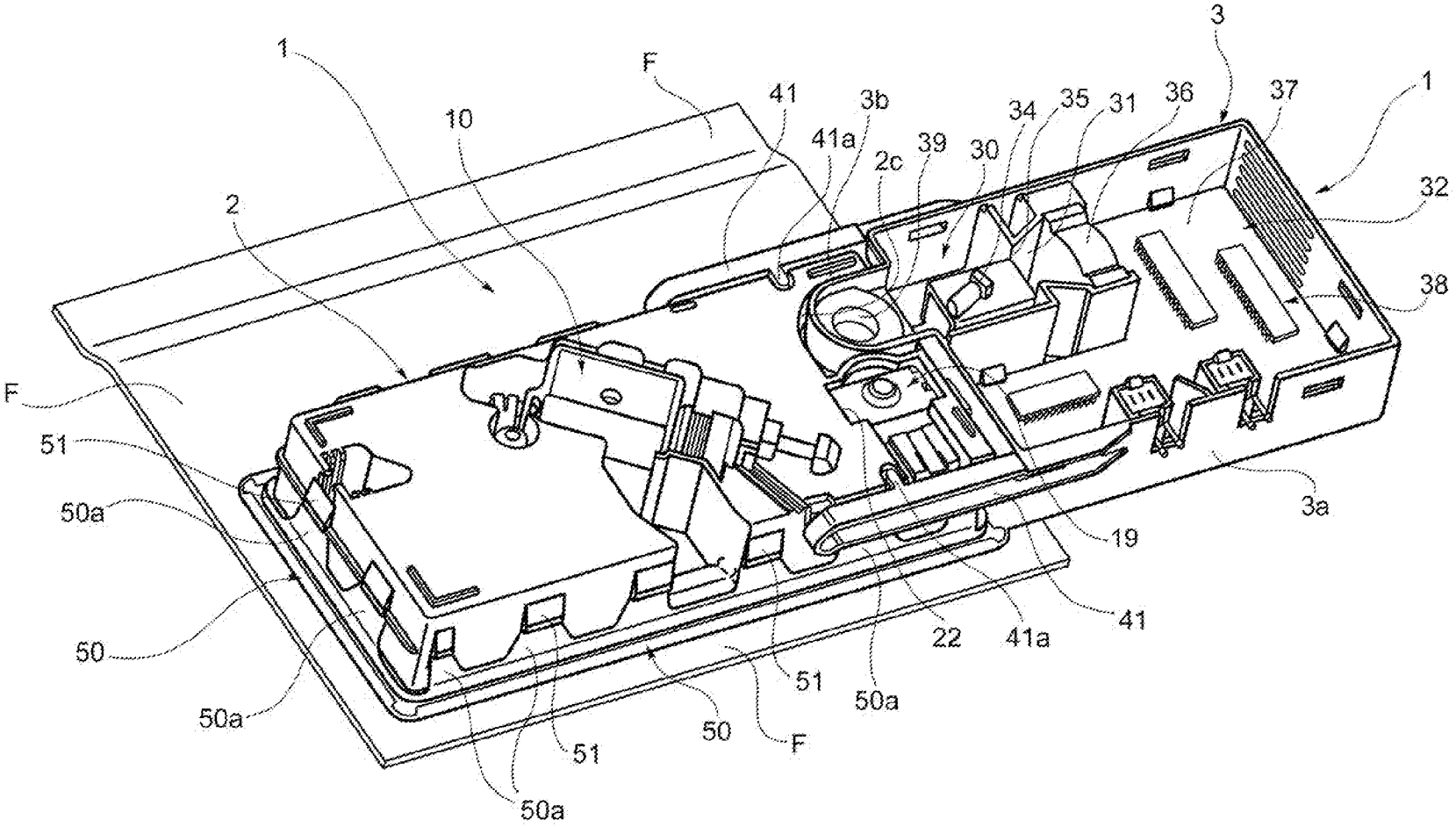

With reference again to FIG. 6, on the side facing the inside the of the integrated dispensing device 2, the edge of the opening 14 forms a kind of valve seat 14*a* with an associated closing member 17 mounted on a movable core 18 of a solenoid control device denoted overall by 19 (see also FIGS. 3 and 4).

Overall, the valve seat 14*a*, the closing member 17 and the associated solenoid control device 19 form an electric cut-off valve device associated with the opening 14. This electric valve device is conveniently of the normally closed kind and has a spring 20 (FIG. 6) tending to keep the closing member 17 engaged with the seat 14*a*, when the solenoid 21 of the control device 19 is de-energized.

With reference to FIGS. 2, 3 and 6, the solenoid control device 19 is mounted in a rear niche 22 provided in the body 2*a* of the integrated dispensing device 2 and has a multipolar electrical connector 23 (FIG. 6) accessible from the outside, for connecting this device 19 to an electronic control unit of the machine WD.

During operation, energization of the solenoid 21 of the control device 19 causes the movable core 18 to be attracted and the closing member 17 to move away from the seat 14*a*, so that the outlet chamber 13 is thus placed in communication with the washing chamber C of the machine WD, via the recess 15 and the grille 16 which is permeable to gases.

With reference to FIGS. 2 to 5, in the embodiment shown the ozone-generating device 3 has a housing 3*a* with an essentially parallelepiped shape. In FIG. 4 this housing is shown with the main rear wall removed, so as to allow viewing of its interior.

With reference therefore to FIG. 4, a series of chambers denoted by 30, 31 and 32 are defined inside the housing 3*a*, adjacent to each other.

The chamber 30 extends close to the side of the housing 3*a* which is adjacent to the integrated washing-agent dispensing device 2 and has, mounted inside it, an electric ozone-generating device 34 of the type known per se.

The chamber 31 is adjacent to the chamber 30 and communicates with it via a passage 35 and contains an electric fan 36 intended to direct an air flow towards the chamber 30 during operation.

The chamber 32 houses a printed circuit board 37 with components 38 of circuits controlling the ozone generator 34 and the electric fan 36.

As can be seen in FIGS. 3 to 5, the housing 3*a* of the ozone-generating device 3 has a protuberance 3*b* defining an extension of the chamber 30 (see FIG. 4) towards the integrated dispensing device 2. This protuberance 30 has an opening 39 formed therein (FIGS. 4 and 5), a sealing ring 40 being arranged on the outer surface of said protuberance 30 around said opening (FIG. 5).

The housing 3*a* of the ozone-generating device 3 in the embodiment shown is coupled to the body 2*a* of the integrated washing-agent dispensing device 2 in a rotatable manner. In particular, the housing 3*a* of the ozone generator 3 has two parallel appendages 41, the far ends of which have respective pin-like formations which engage inside corresponding support recesses 2 in the body 2*a* of the integrated device 2.

The ozone generator 3 is therefore able to assume, with respect to the integrated dispensing device 2, an angular mounting position, shown in FIG. 5, where it may be introduced, together with the device 2, through the opening G in the wall F of the door D.

The ozone generator 3 is then able to assume a following stable working position, after the assembly 1 has been mounted through the opening G in the wall F, this stable working position being shown in FIGS. 2 to 4. In this working position the ozone-generating device extends entirely behind the sheet-like wall F of the door D of the washing chamber of the machine WD.

In order to stabilize the ozone generator 3 in the working position, its appendages 41 are for example provided with respective oppositely arranged projections 41*a* (FIGS. 3 and 4) which can be snap-engaged and retained inside corresponding seats provided in the body 2*a* of the integrated detection device 2.

When the ozone-generating device is arranged in the working position (FIGS. 2 to 4), its protuberance B extends inside a corresponding niche 2*c* provided in the rear part of the body 2 of the integrated dispensing device 2 (see also FIG. 6).

The bottom wall of the niche 2*c* is provided with an opening 2*d* which has a projecting outer edge 2*e* able to engage sealingly with the ring 40 mounted in the protuberance 3*b* of the ozone generator 3 around the outflow opening 39 thereof.

As can be seen in FIG. 6, inside the body 2*a* of the integrated dispensing device 2, the opening 2*d* communicates with the outlet chamber 13 via a passage denoted by 45.

The arrangement is such that, when the ozone generator 3 is arranged in the working position (FIGS. 2 to 4), the chamber 30 of this generator is connected to the outlet chamber 13 of the integrated dispensing device 2, via the opening 39 in the protuberance 3*b* of the ozone generator, and the opening 2*d* and the passage 45 of the integrated dispensing device 2.

Therefore, when the ozone-generating device 34 and the associated electric fan 36 are activated, a flow of air and ozone is able to reach the outlet chamber 13 in the body of the integrated dispensing device 2. By means of energization of the solenoid 21 of the control device 19 (FIG. 6) it is thus possible to open the outflow opening 14 of the outlet chamber 13, so that the air and ozone flow may be dispensed towards the washing chamber C of the machine WD.

As persons skilled in the art may appreciate, the combined assembly 1 according to the present invention requires the provision solely of the opening G in the wall F of the door D, this opening being typically necessary for mounting only the integrated washing-agent dispensing device 2. No additional opening is therefore required for installation of the ozone-generating device.

As a result of the present invention it is possible to provide an integrated washing-agent dispensing device having the outlet chamber 13, the passage 45 and the opening 2*d* and optionally provided with the electric valve device 17-23 if the machine WD is to be equipped also with the ozone-generating device 3.

Fixing of the entire combined assembly 1 to the wall if of the door D is performed by fixing the body 2*a* of the integrated dispensing device 2 in one of the various manners known per se. In the embodiment shown by way of example in FIGS. 3 and 4 this is achieved by means of a frame 50 which can be arranged around the periphery of the rear part of the body 2*a*, after the latter has been positioned inside the opening G in the wall F of the door of the machine WD.

The frame 50 is provided with a plurality of resilient tongues 50*a* which are able to snap-engage over and against corresponding retaining projections 51 provided along the contour of the rear part 2*a* of the integrated washing-agent dispensing device 2.

Obviously, without affecting the principle of the invention, the embodiments and the constructional details may be significantly varied with respect to that described and illustrated purely by way of a non-limiting example, without thereby departing from the scope of the invention as defined in the accompanying claims.

The invention claimed is:

1. An assembly for dispensing washing agents into a washing chamber of a dishwashing machine, the assembly comprising:

a washing agent dispensing device for dispensing the washing agents and comprising a body configured to be mounted in an opening of a sheet-like wall which delimits the washing chamber and which has a peripheral formation which protrudes towards the outside and is configured to abut against the surface of said wall surrounding said opening, on the side of said wall which faces the washing chamber; and an ozone-generating device including a housing which has an outlet opening and contains electric ozone-flow generating means for emitting a flow of ozone towards said outlet opening, so as to introduce the flow of ozone into the washing chamber of the machine;

wherein in the body of the washing-agent dispensing device there is defined an outlet chamber communicating, in the condition of use, with the washing chamber and having an inlet passage accessible from the outside, and wherein the housing of the ozone-generating device is coupled to and supported by the body of the washing-agent dispensing device so as to be displaceable with respect thereto between:

a mounting position in which said housing of the ozone generating device is introduced, together with said body of the washing agent dispensing device, through said opening in the wall of the washing chamber, and the outlet opening of said housing is uncoupled from the inlet passage of the outlet chamber of the washing agent dispensing device, and a working position in which the outlet opening of said opening of said housing is sealingly coupled with the inlet passage of said outlet chamber so as to allow the supply of a flow of ozone towards the outlet chamber, and the housing of the ozone-generating device extends with an orientation such that in the condition of use the ozone generating device extends behind said sheet-like wall of the washing chamber.

2. The assembly according to claim 1, wherein the housing of the ozone-generating device is coupled to the body of the washing agent dispensing device in a rotatable manner so as to be movable between said mounting position and said working position.

3. The assembly according to claim 1, wherein the body of the washing agent dispensing device includes an electric cut-off valve device for controlling the supply of ozone from said outlet chamber to the washing chamber.

* * * * *